United States Patent [19]

Hashii

[11] Patent Number: 4,837,981

[45] Date of Patent: Jun. 13, 1989

[54] POWER OPERATED SANDING MACHINE

[75] Inventor: Toshimitu Hashii, Hiroshima, Japan

[73] Assignee: Ryobi Limited, Hiroshima, Japan

[21] Appl. No.: 214,040

[22] Filed: Jun. 30, 1988

[30] Foreign Application Priority Data

Jul. 6, 1987 [JP] Japan ..... 62-104237[U]
Jul. 9, 1987 [JP] Japan ..... 62-106205[U]
Jul. 10, 1987 [JP] Japan ..... 62-106637[U]
Jul. 20, 1987 [JP] Japan ..... 62-111705[U]

[51] Int. Cl.[4] ..... B24B 23/04
[52] U.S. Cl. ..... 51/170 MT; 51/386
[58] Field of Search ..... 51/170 MT, 170 R, 170 TL, 51/382, 386

[56] References Cited

U.S. PATENT DOCUMENTS 3,849,943 11/1974 Thomas et al. .
4,549,371 10/1985 Hakoda .
4,625,462 12/1986 Fushiya et al. ..... 51/170 MT
4,744,177 5/1988 Braun et al. ..... 51/170 MT

FOREIGN PATENT DOCUMENTS 1216238 12/1970 United Kingdom ..... 51/170 MT

*Primary Examiner*—Roscoe V. Parker
*Attorney, Agent, or Firm*—Oliff & Berridge

[57] ABSTRACT

A sanding machine comprising: a housing; a pad base; a pad; a suspension for suspending the pad base from the housing, the suspension being formed of elastic material; a fastener for detachably fixing the pad base to the suspension; a sand paper clamp having a fixing portion for providing a sand paper over the lower surface of the pad; a fastener for detachably securing the pad to the pad base; and a restraint for restraining distortional rotation of the suspension when the pad base is secured to the suspension by the fastener. The restraint also serves as a position adjustor for aligning the attaching portion of the sand paper clamp and the pad base with the suspension.

14 Claims, 5 Drawing Sheets

POWER OPERATED SANDING MACHINE

BACKGROUND OF THE INVENTION

The present invention relates to a power operated sanding machine, and more particularly, a hand-manupulated portable sanding machine which performs orbitary sanding operation with respect to a workpiece.

A sanding machine generally includes a pad for supporting a sanding paper, a pad base connecting with the pad and a power source. According to a conventional sanding machine, a pad base is suspended to a frame through a flexible suspension means so as to minimize vibration to be transmitted to an operator from a workpiece as disclosed in U.S. Pat. No. 4,549,371 commonly assigned. Further, the pad base is generally secured to the suspension means by means of screws. That is, for fixing the pad base to the suspension means, holes formed in the pad base are aligned with holes of the suspension means, and then the screw is inserted into these holes.

In such fixing structure, the suspension means is rotationally distorted due to its flexibility when the screw is threadingly engaged with the holes of the suspension means. In case of the over-distortion, the suspension means may be broken. Further, it would be rather difficult to provide positional alignment between the holes of the pad base and the suspension means, since the pad base covers the holes of the suspension means. Therefore, sufficient assembleability may not be attainable.

Further, according to another conventional sanding machine described in U.S. Pat. No. 3,849,943, the pad is directly bonded to the underside of the pad base by adhesive agent. Therefore, if the replacement of the pad is required, the pad together with the pad base are replaced by a new one. However, the pad base is generally coupled to an eccentric shaft for a fan which shaft is connected to a motor shaft, or the pad base is coupled to a bearing portion of the fan which is connected to the eccentric shaft connected to the motor shaft by a pin. Further, the pad base is also connected, through the screws, to the suspension means suspended from a main frame of the sanding machine. Therefore, in order to remove the pad base from the sanding machine, various mechanical components must be disassembled. Such disassembling work is troublesome and time consuming. Furthermore, various kinds of pad bases are required in accordance with the variations of the pads, which in turn increases overall costs.

According to still another aspect, according to the conventional sanding machine, if the sanding machine is dropped or is mechanically interfered with ambient rigid components, external force is applied to the sander. In this case, since the suspension means is formed of elastic material such as resin or rubber reinforced by a wire, the suspension means is largely bent deformed due to the external impact. If the deformation exceeds an allowable elastic deformation range which is required for ordinary orbitary sanding work, the suspension means may be broken. Therefore, such excessive displacement or distortion of the suspension means must be obviated.

Furthermore, according to a conventional sanding machine, a sanding paper must be provided over the pad. For fixing the sanding paper to the sander, one end of the sanding paper is secured between a paper clamp means and an upper surface of the pad base. However, it would be rather difficult to fix the sanding paper at a proper orientation. If the paper is not suitably secured, the paper may be displaced with respect to the pad, or the paper may be distorted when both ends of the paper is secured to the sander. Therefore, in the conventional sanding machine, sanding paper fixing work is repeatedly carried out so as to correctly position the sanding paper with respect to the pad, which is troublesome and time consuming.

SUMMARY OF THE INVENTION

It is therefore, an object of the invention to overcome the above-described drawbacks and to provide an improved sanding machine.

Another object of the invention is to provide such sanding machine which can prevent an elastic suspension means from being distorted when a fixing screw is rotationally engaged therewith.

Still another object of the invention is to provide such sanding machine in which a paper clamp means and a pad base are promptly aligned with the suspension means.

Still another object of the invention is to provide such sanding machine capable of preventing the elastic suspension means from overbending or distortion even if external force is applied to the sanding machine.

Still another object of the invention is to provide the sanding machine in which a pad can be easily exchanged by a new one regardless of the disassembly of the pad base.

Still another object of the invention is to provide the sanding machine capable of attaching a sanding paper to the pad without any offsetting relationship therebetween and without any distortion of the sanding paper.

Still another object of the present invention is to provide such sanding machine having simplified construction yet achieving the above-mentioned objects.

Still another object of the invention is to provide a pad base fixing structure, a pad fixing structure, a over-distortion or overbending preventive means for the elastic suspension means and sandpaper attaching structure in the improved sanding machine.

These and other objects of the invention will be attained by providing a sanding machine comprising: a housing; a pad base; a pad; suspension means for suspending the pad base from the housing, the suspension means being formed of elastic material; fixing means for detachably fixing the pad base to the suspension means; sand paper clamping means having a fixing portion for providing a sand paper over the lower surface of the pad; attaching means for detachably securing the pad to the pad base; and, restraint means for restraining distortional rotation of the suspension means when the pad base is secured to the suspension means by the fixing means. The restraint means also serves as position adjusting means for aligning the attaching portion of the sand paper clamp means and the pad base with the suspension means when these components are assembled together.

In one preferred embodiment, each of the suspension means has a cross-sectional shape other than a circle. Further, the fixing portion of the paper clamp means has a shape identical with the cross-sectional shape of the suspension means. The suspension means and the fixing portion are fitted with the restraint means having a shape identical with the cross-sectional shape of the suspension means. Therefore, even if the fixing means is rotationally attached to the suspension means, the latter is never distortionally rotated since the outer surface of the suspension means is in close contact with the restraint means.

In another aspect of the invention, the attaching means includes a plurality of bosses and equal plurality of screws. Each of the bosses is positioned outwardly with respect to the restraint means and extends from the pad base. Each free ends of the bosses are abuttable on an inner peripheral surface of the skirt portion of the frame or housing. Therefore, even if extraordinary load is applied to the sanding machine, over-bending of the elastic suspension means can be eliminated because of the abutment between at least one of the bosses and the skirt portion, whereby the suspension means can be protected without any damage.

Still another aspect of the invention, the pad can be detachably provided to the pad base by means of the attaching means. Accordingly, it is unnecessary to disassemble the pad base for exchanging the pad with a new one.

Still another aspect of the invention, there are further adjusting means for adjusting fixing position of the sand paper with respect to the pad. Therefore, the sand paper can be accurately provided over the pad without any offsetting relationship therebetween.

BRIEF DESCRIPTION OF THE DRAWINGS

In the drawings;

FIG. 3(*b*) is a bottom view showing the suspension means;

FIG. 5(*b*) is a side view showing the paper clamp means;

DETAILED DESCRIPTION OF THE PREFERRED EMBODIMENT

Figure 1:
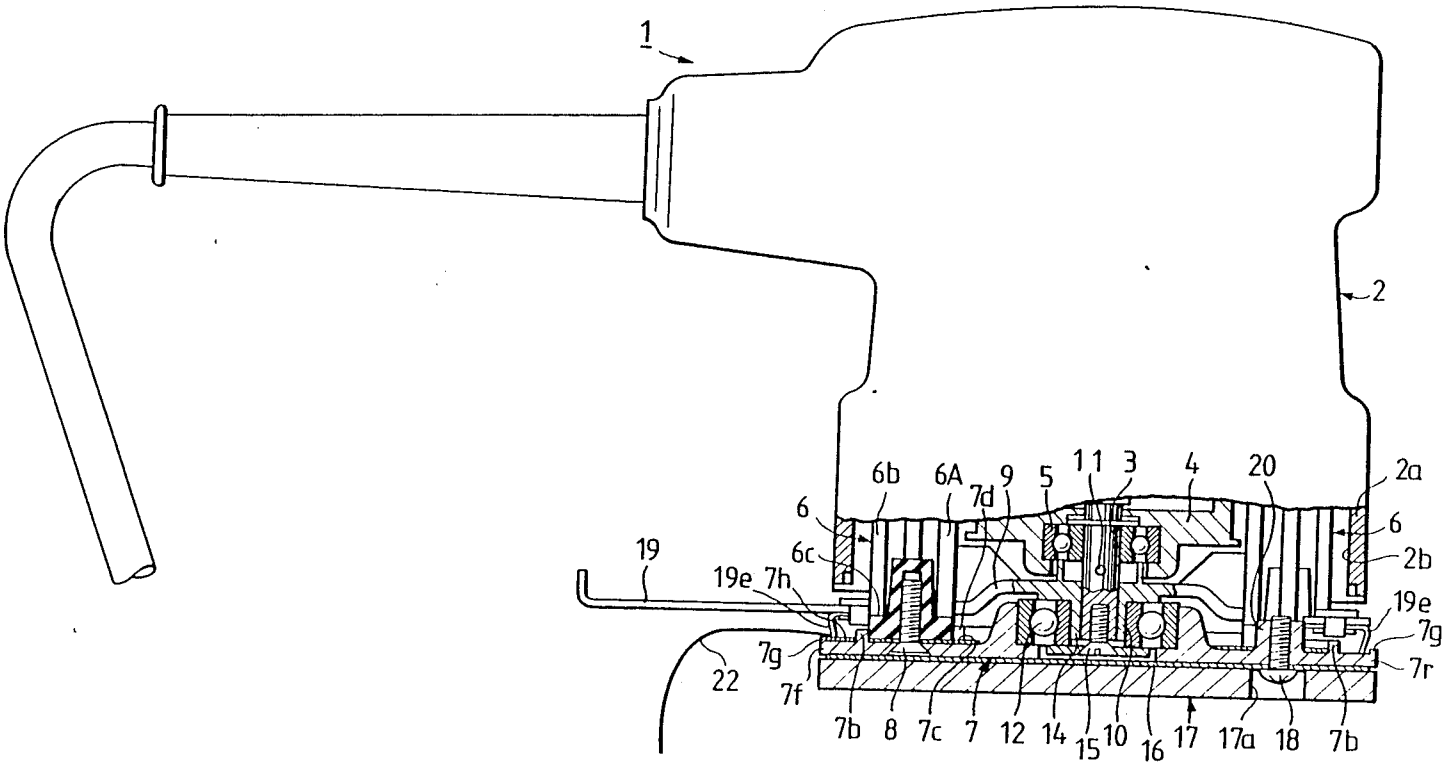
FIG. 1 is a side view partially cross-sectioned showing a sanding machine according to the present invention.

In FIG. 1, a power operated portable sanding machine is generally indicated by reference numeral 1. The sanding machine 1 includes a hollow frame or housing 2 which constitutes an outer casing in which a drive motor (not shown) is accommodated. The housing has a skirt portion 2*a* at its lower portion. The drive motor has a motor shaft 3 whose upper portion is rotatably supported to the a supporting portion (not shown) of the frame 2 by an upper bearing (not shown), and whose lower portion is rotatably supported to a lower supporting portion 4 of the frame 2 by a lower bearing 5.

The lower end portion of the motor shaft 3 extends further downwardly through the lower supporting portion 4 and is inserted into a hollow eccentric shaft 10 which is integrally and concentrically provided with fan 9. The lower end portion of the shaft 3 is fixedly secured to the hollow eccentric shaft 10 by a pin 11. As a result, the fan 9 is rotatable upon energization of the motor.

A suspension means 6 including a plurality of suspension members 6A (four members in the embodiment) are suspended from the frame 2. The suspension means is formed of elastic materials. A pad base 7 is secured to lower end portions of the suspension members 6A by screws 8 and extends in horizontal direction. Therefore, the pad base 7 is suspended by the frame 2 through the suspension members 6A. Further, a pad 17 and a pad plate 16 integral therewith are secured to the pad base 7. The pad plate 16 is fixedly secured to one surface (upper surface) of the pad 17 by an adhesive agent, so that the pad plate 16 is connected to the pad base 7. Furthermore, a sanding paper 22 (FIG. 9) is installed over another surface (lower surface) of the pad 17. A paper clamp means 19 is provided for providing the sanding paper over the bottom surface of the pad 17. The paper clamp means 19 is also supported to the frame 2 by means of the suspension means 6. These pad base fixing structure, a pad fixing structure, and sanding paper fixing structure are one of the features of the present invention and will be described later in detail.

The pad base 7 is supported by the eccentric shaft 10 through a bearing 12, and the bearing 12 is supported by a holder plate 14 secured to a planar end face of the eccentric shaft 10 by a screw 15. Therefore, upon energization of the motor, the pad base 7 together with the pad plate 16 the pad 17 and the sanding paper 22 are orbitarily rotated by the eccentrically rotational movement of the shaft 10.

Figure 2:
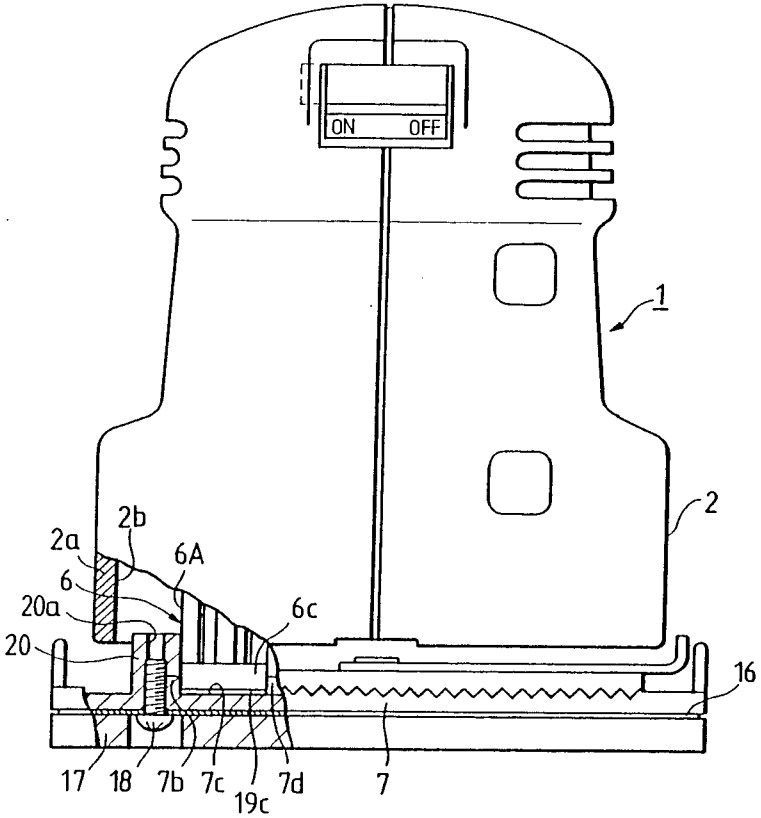
FIG. 2 is a front view partially cross-sectioned showing the sanding machine of the invention.

As shown in FIGS. 1 and 2, the pad base 7 is integrally provided with bosses 20 (four bosses in the embodiment) so as to detachably secure the pad plate 16 by screws 18 to the pad base 7. More specifically, the pad 17 is formed with holes 17*a* at positions corresponding to bosses 20 so that the heads of the screws 18 do not project out of the lower bottom surface of the pad 17.

Details of the pad base fixing structure will next be described with reference to FIGS. 1 thru 5(*b*). The fixing structure includes restraint means for restraining distortional rotation of the elastic suspension means 6. And the restraint means also serves as position adjusting means for adjusting position of a paper clamp means 19 and the pad base 7 relative to the suspension means 6.

The suspension means 6 is formed of a material having sufficient tensile strength and compression strength capable of suspending the pad base 7. Further, the material has sufficient flexibility capable of sustaining deforming displacement caused by the eccentrical rotation of the eccentric shaft 10. Suitable material may be, for example, urethane rubber or soft plastic material.

Figure 3A:
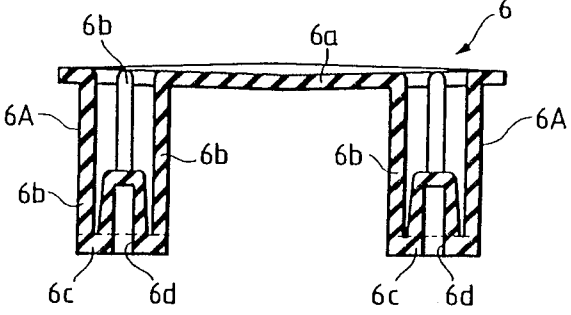
FIG. 3(*a*) is a front view showing a suspension means according to the invention.
Figure 3B:
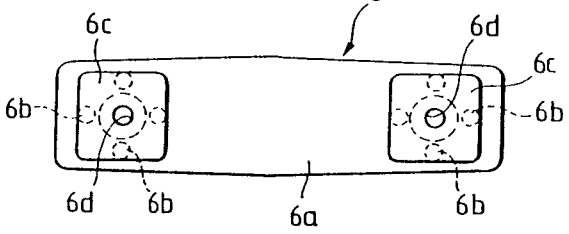
Figure 4:
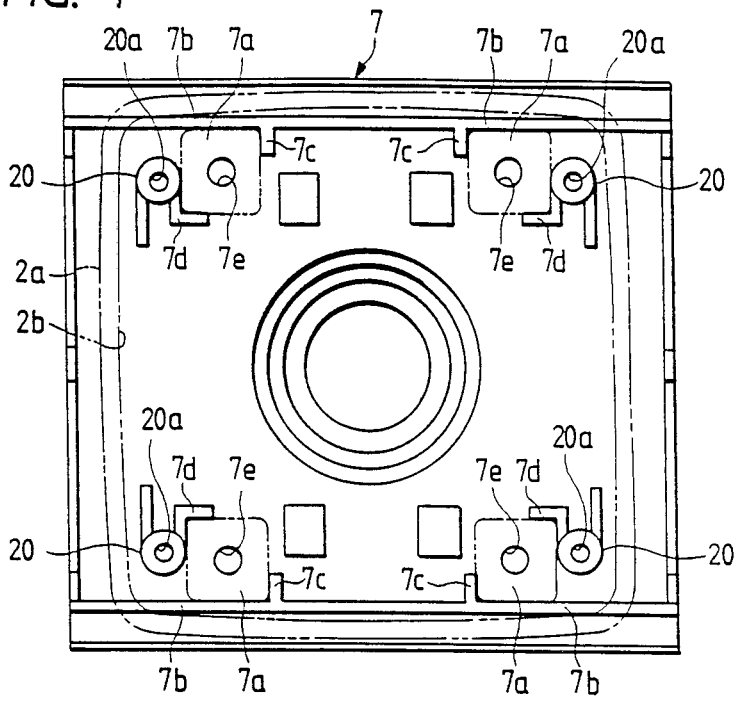
FIG. 4 is a plan view showing an inner side of a pad base according to this invention.

Each of the suspension members 6A is of hollow shape. Alternatively, as shown in FIGS. 3(*a*) and 3(*b*), the suspension means 6 has a main body 6*a* from which four rod members 6*b* extend. The four rod members 6*b* are equidistantly provided, and lower ends of the rod members 6*b* are integrally provided with a pad base fixing portion 6*c* having inverse cup shape. The fixing portion 6*c* has a relatively large thickness and is formed with a central hole 6d with which the screw 8 is threadingly engaged. Each of the fixing portion 6c has a flat bottom surface and has an oval or polygonal cross-section other than circular cross-section. In the embodiment a rectancular cross-section is shown in FIG. 3(*b*). As shown in FIG. 4, a plurality of fixing portions 6c are provided integral with the main body 6a , so that the fixing portions 6c are positioned equi-distant. (In FIG. 4, the fixing portions 6c provides square line when neighbouring portions 6c are line-connected together.

Figure 5A:
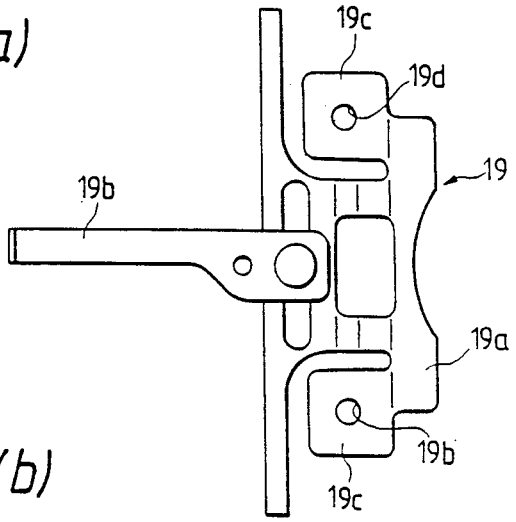
FIG. 5(*a*) is plan view showing a paper clamp means according to the invention.
Figure 5B:
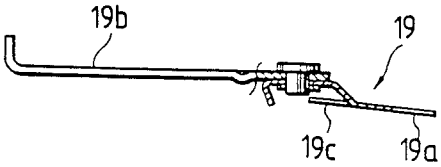

The paper clamp means 19 is also shown in FIGS. 5(*a*) and 5(*b*). The paper clamp means 19 has a base plate 19a from which a lever member 19b extends. The lever member 19b extends from a latereally central portion of the base plate 19a, and paper clamp fixing plates 19c are provided at both lateral sides of the base plate 19a. Each of the paper clamp fixing plates 19c has an oval or polygonal cross-section other than circular cross-section. The shape of each of the fixing plates 19b is identical with the cross-sectional shape of the each of the fixing portion 6c of the supension member 6. Further, a central bore 19d is formed in the fixing plates 19b so as to allow the screw 8 to pass therethrough. The bore 19d is formed at a position corresponding to the central hole 6d of the suspension member 6.

The pad base 7 is best shown in FIG. 4, which is the internal side thereof. The pad base 7 has fixing or seat portions 7a at positions corresponding to the fixing portions 6c of the suspension member 6 and the fixing plates 19b of the paper clamp means 19. At the fixing portions 7a, there are formed with rib portions (first group of ribs) 7b. Each of the rib portions 7b serves to engage the outer surfaces of the each of the fixing portions 6c and the fixing plates 19c as well as to provide position adjustment thereof. As shown in FIG. 4, the seat portion 7a includes L-shaped ribs 7c and 7d (the first group of ribs) which are in surface contact with the outer peripheral surface of the fixing portion 6c, so that the fixing portions 6a engaging the ribs 7c and 7d are not distortionally rotatable about their axes due to their elasticity or flexibility when the screw 8 is threadingly engaged with the central hole 6d. Alternatively, recesses are formed at the inner (upper) surface of the pad base 7 at positions corresponding to the seat portions 7a instead of the formations of the ribs. In any event, the seat portions 7a prevents the flexible fixing portions 6c from being rotated or twisted because of the cross-sections thereof other than a circle in spite of the forcible threading engagement between the screw 8 and the fixing portion 6c. Each of the seat portion 7a is formed with a central hole 7e for permitting the screw 8 to pass therethrough. Of course, the central hole 7e is in alignment with the holes 6d and 19d.

Figure 6:
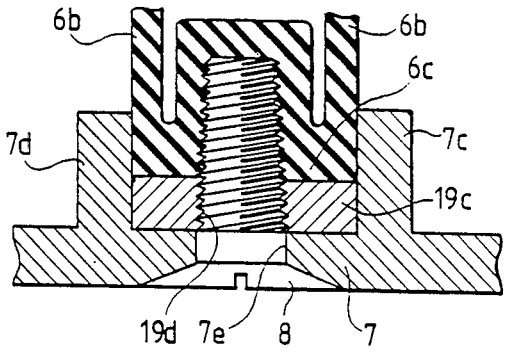
FIG. 6 is a cross-sectional view showing an essential portion of a pad base fixing structure according to this invention.
Figure 7:
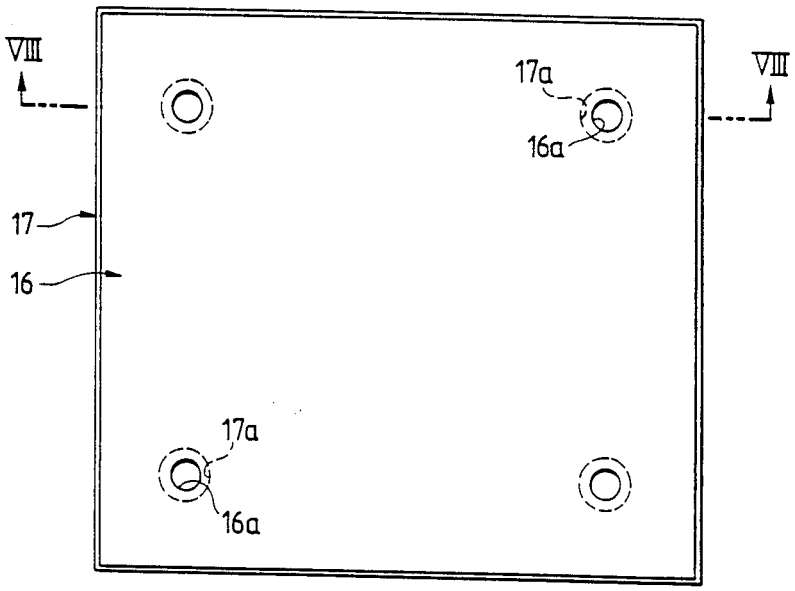
FIG. 7 is a plan view showing a pad plate and a pad according to this invention.
Figure 8:
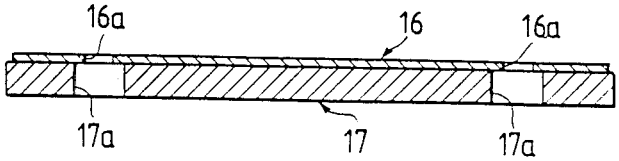
FIG. 8 is a cross-sectional view taken along the line VIII—VIII of FIG. 7.

For assembling the pad base 7 and the paper clamp means 19.to the suspension means 6, the fixing plates 19c of the paper clamp means 19 is fitted with the seat portions 7a of the pad base 7, and then, the fixing portions 6c of the suspension members 6 are fitted with the seat portions 7a at positions above the fixing plates 19c as shown in FIG. 6. Thereafter, the screw 8 is inserted through the hole 7e of the pad base 7 and into the holes 19d of the paper clamp means 19 and the holes 6d of the suspension means 6. As a result, the pad base 7 and the paper clamp means 19 are suspended to the frame 2 through the suspension means 6. When clamping the screw 8, the suspension means 6 is subjected to rotational force about its axis. However, since the suspension means 6 is fitted with the seat portion 7a of the pad base 7, the rotation or any displacement of the suspension means 6 is avoidable at the time of clamping. As a result, the elastic suspension means 6 is never distorted, and further, the paper clamp means 19 is assembled at a given location because of the stationary orientation of the suspension means 6.

With such structure, the engagement between the suspension means 6 and the seat portions 7a can prevent the suspension means 6 from its distortion during screw insertion as well as provide prompt position setting of the pad base 7 and the paper clamp 19 with respect to the frame 2. As a result, excellent assembleability is provided with simplified construction.

In accordance with the present invention, the pad 17 is not integral with the pad base 7. Instead, the pad 17 is detachably secured to the pad base 7 by means of the screws 18 through the pad plate 16. With such construction, the pad itself can be easily exchanged by a new one without disassembly of the pad base 7 relative to the frame 2.

The pad plate 16 has thin thickness and is formed of metal or plastic material. Further, the plate 16 has sufficient mechanical strength to support the pad 17 at one surface thereof. As described above, the pad 17 is fixedly secured to the pad plate 16 by adhesive agent. The pad plate 16 has an external size at least equal to or smaller than that of the pad 17 as shown in FIGS. 1 and 2 so that the outer edge of the pad plate 16 is positioned inwardly with respect to the outer edge of the pad 17. Further, the shape of the pad plate 16 is analogous to that of the pad 17 so as to provide sufficient bonding strength therebetween.

The pad 17 and the pad plate 16 are formed with bores 17a and 16a, respectively. These bores are in alignment with each other so as to allow the screw 18 to threadingly engage therewith. The bores 17a has an inner diameter larger than an outer diameter of the head of the screw 18, so that the screw head does not project out of the lower surface of the pad 17.

For assembling the pad to the pad base 7, the pad plate 16 is positioned to the lower face of the pad base 7 so as to align the bores 17a and 16a with bores 20a of the bosses 20 integrally provided at the pad base 7 as shown in FIGS. 1 and 4. In the embodiment, four bosses 20 are symmetrically and equi-distantly provided at the pad base 7 and at positions outwardly with respect to the first group of ribs 7b,7c and 7d as shown in FIG. 4. Then, the screws 18 are inserted through the bores 17a and 16a into the bores 20a, so that the pad plate 16 together with the pad 17 are assembled to the pad base 7.

Therefore, in the present invention, various kinds of pads can be provided to the pad base 7 by means of the screws 18 without any disassembly of the pad base 7, and pad exchanging work can be easily performed at low cost because of simple construction.

These bosses 20 also serve stop means for preventing the pad or pad base from its excessive eccentrical movement. More specifically, when external force is applied to the sanding machine, the pad base and the pad may be excessively moved exceeding the orbitary rotational locas thereof due to bending of the flexible suspension means 6. If the bending of the suspension means 6 exceeds the elastic deformation range thereof, the suspension means 6 may be broken. In this connection, the bosses 20 serve to prevent the suspension means 6 from its excessive deformation due to impact application thereto.

These bosses 20 extend upwardly from the upper surface of the pad base 7 as shown in FIGS. 1 and 2. The axial length of the bosses 20 is so determined that the tip ends of the bosses 20 can abut an inner surface 2*b* of the skirt portion 2*a* of the frame 2. The bosses 20 do not abut the inner surface 2*b* during normal orbitary movement of the pad base 7 as shown in FIG. 4. However, if the pad base 7 undergoes external force, which force exceeds the orbitary rotational force of the pad base with bending deforming or bending the suspension means 6, at least one of the bosses 20 will be brought into abutment with the inner surface 20*b* of the skirt portion 20*a*. Therefore, further displacement of the pad base 7 is restrained by the abutment between the boss 20 and the surface 20*b*. As a result, excessive deformation of the suspension means 6 can be obviated.

In a preferred embodiment, a cushioning member can be provided to at least one of the boss 20 and the inner surface 2*b* so as to reduce the mechnical shock when the boss abuts the inner surface.

Therefore, according to the present invention, even if the sanding machine is mechanically interfered with other ambient components or the sanding machine is inadvertantly dropped, the impacting force may be transmitted to the pad base 7 and the pad 17, so that these are rotated or laterally moved accompanying the deformation of the flexible suspension means 6. However, this exceesive deformation of the flexible suspension means 6 is restrained by the abutment of the boss 20 against the inner surface 2*b* of the skirt portion 2*a* of the frame 2. As a result, the suspension means 6 cannot be further moved, to thereby protect the suspension means 6. Such protective means is easily obtained by the extension of the boss 20 to a suitable position so as to be abuttable to the inner surface 2*b*.

Referring back to the pad base 7, the rib portion 7*b* also serves as a sand paper positioning means. More specifically, the pad base 7 has retangular shape as shown in FIG. 4 and has front and rear end portions 7*f* and 7*r*. At distal ends of the front and rear portions, ribs 7*f* (second group of ribs) extend in parallel with the distal end lines. Further, the above-described ribs 7*b* also extend in parallel with the ribs 7*g*. Entire length of the ribs 7*b* are referred as a third group of ribs in claims. The ribs 7*b* are positioned inwardly with respect to the ribs 7*g* and extend over full length of the pad base 7 as shown in FIG. 4.

Figure 9:
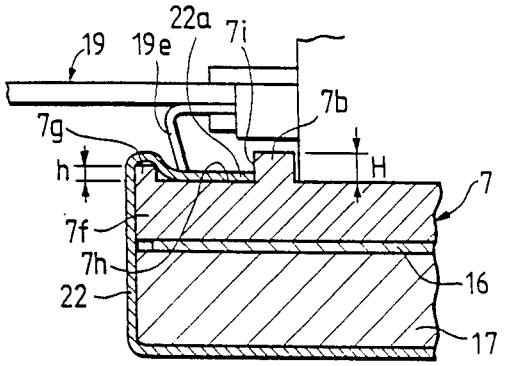
FIG. 9 is an enlarged side view partially crosssectioned particularly showing a sanding paper attaching arrangement according to this invention; and, FIG. 10 is a front view particularly showing the sanding paper attaching arrangement according to this invention.
Figure 10:
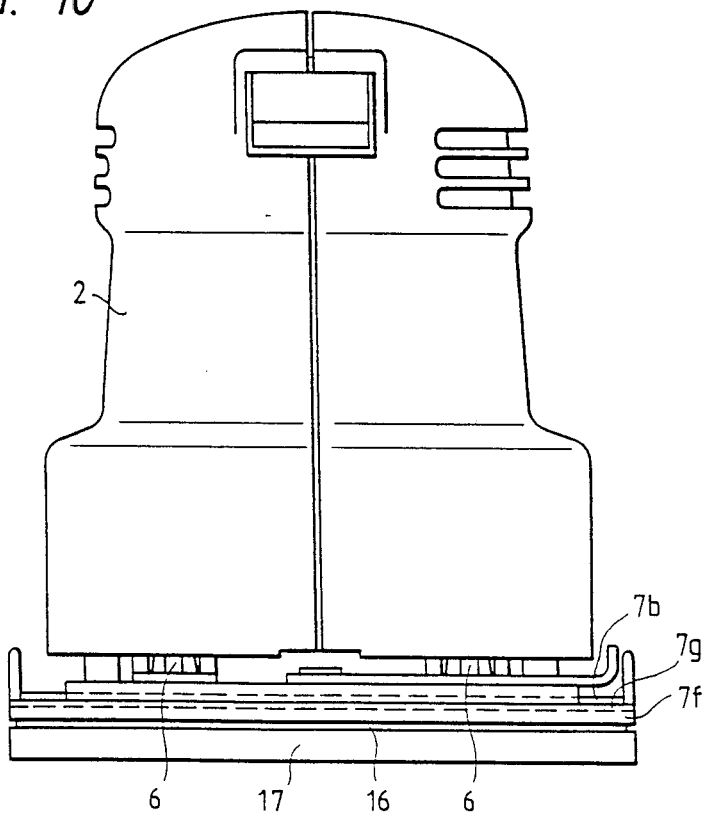

The above described paper clamp means 19 has a clamp piece 19*e* whose tip end is positioned between the ribs 7*g* and 7*b* as best shown in FIG. 9. With the structure, the end portion 22*a* of the sanding paper 22 is supported by the clamp piece 19*e*, the rib 7*g*, and an upper face 7*h* of the pad base 7.

These ribs 7*b* are adapted for abutting the sand paper edge thereagainst so as to perform position setting of the sand paper with respect to the pad base 7. The projection length H of the ribs 7*b* is higher than projection length h of the ribs 7*f*, so that the sand paper edge is easily abuttable against an outside face 7*i* of the rib 7*b*.

For clamping the sanding paper 22 to the pad base 7, the paper clamp means 19 is unfastened, so that the paper end 22*a* is inserted through a space defined between the rib 7*g* and the clamp piece 19e. When the edge of the sanding paper 22 abuts the outer face 7*i* of the rib 7*b*, the paper clamp means 19 is fastened to fixely secure the one end of the sanding paper. Then, remaining portion of the sanding paper 22 is provided along the bottom face of the pad 17, so that the opposite end of the sanding paper 22 is also secured to the pad base 7 by means of the paper clamp means 19. It goes without saying that the opposite end portion of the pad base 7 is also provided with the ribs 7*g* and 7*b* as well as the clamp piece 19*e*.

According to the invention, upon abutment of the paper end against the rib 7*b*, the sanding paper 22 is automatically subjected to positional adjustment. That is, the sanding paper is accurately directed in parallel with the pad base 7. As a result, the sanding paper 22 can be promptly installed over the pad 17, and no paper displacement or distorsion occur after it is fixed to the pad base 7 by means of the clamping means 19.

While the invention has been described in detail and with reference to specific embodiment thereof, it will be apparent for those skilled in the art that various changes and modifications can be made without departing from the spirit and scope of the invention.

What is claimed is:

1. A sanding machine comprising:

a housing having a lower skirt portion;

a pad base having an upper and lower surfaces;

a pad having an upper and lower surfaces; suspension means for suspending said pad base from said housing, said suspension means being formed of elastic material;

fixing means for detachably fixing said pad base to said suspension means;

sand paper clamping means having a fixing portion for providing a sand paper over said lower surface of said pad;

attaching means for detachably securing said pad to said pad base; and, restraint means for restraining distortional rotation of said suspension means when said pad base is secured to said suspension means by said fixing means.

2. The sanding machine as defined in claim 1, wherein said restraint means is provided at said upper surface of said pad base, said restraint means being defined by recesses formed in said upper surface of said pad base, said recesses having a cross-section other than a circle and a shape identical with a shape of said attaching portion and cross-sectional shape of said suspension means.

3. The sanding machine as defined in claim 1, wherein said restraint means comprises a first group of ribs provided on said upper surface of said pad base, said ribs having side surfaces in close contact with said suspension means and said attaching portion, and said ribs providing a shape other than a circle in combination and identical with a shape of said attaching portion and a cross-sectional shape of said suspension means.

4. The sanding machine as defined in claim 1, further comprising position adjusting means for aligning said attaching portion of said sand paper clamp means and said pad base with said suspension means, said restraint means serving as said position adjusting means.

5. The sanding machine as defined in claim 1, wherein said attaching means comprises;

a plurality of bosses projecting from said upper surface of said pad base and positioned outwardly with respect to said restraint means; and, equal plurality of screws engageable with said bosses, said screws extending through said pad for securing the same to said pad base.

6. The sanding machine as defined in claim 5, further comprising a pad plate integrally provided at said upper surface of said pad, said pad being formed with holes for positioning heads of said screws onto said pad plate, so that said pad is secured to said pad base through said pad plate.

7. The sanding machine as defined in claim 1, further comprising preventive means for preventing said suspension means from excessive bending, said preventive means comprising said skirt portion of said housing and said attaching means abuttable against an inner surface of said skirt portion when said pad base is excessively displaced.

8. The sanding machine as defined in claim 5, further comprising preventive means for preventing said suspension means from excessive bending, said preventive means comprising said skirt portion of said housing and said bosses, at least one of said bosses being abuttable against an inner surface of said skirt portion when said pad base is excessively displaced.

9. The sanding machine as defined in claim 1, further comprising adjusting means for adjusting fixing position of said sand paper relative to said pad, end portion of said sanding paper being clamped between said paper clamp means and said pad base.

10. The sanding machine as defined in claim 3, further comprising adjusting means for adjusting fixing position of said sand paper relative to said pad, end portion of said sanding paper being clamped between said paper clamp means and said pad base.

11. The sanding machine as defined in claim 10, wherein said adjusting means comprises;

a second group of ribs each extending along each edges of said pad base and projecting from said upper surface thereof; and a third group of ribs extending in parallel with said second group of ribs and projecting from said upper surface of said pad base, said third group of ribs being positioned inwardly with respect to said second group of ribs, edges of said sand paper being abuttable against an outer side surface of said third ribs.

12. The sanding machine as defined in claim 11, wherein said paper clamp means has a clamp piece, said clamp piece being positioned between said second and third ribs.

13. The sanding machine as defined in claim 11, wherein a projecting length of said third group of ribs is larger than a projecting length of said second group of ribs.

14. The sanding machine as defined in claim 11, wherein a part of said first group of ribs is compatible with a part of said third group of ribs.

* * * * *